US010982851B2

(12) United States Patent
Bellardi

(10) Patent No.: US 10,982,851 B2
(45) Date of Patent: Apr. 20, 2021

(54) ADDITIVELY MANUFACTURED WALL AND FLOATING FERRULE HAVING A FRANGIBLE MEMBER BETWEEN THE FLOATING FERRULE AND A BUILD SUPPORT ARM

(71) Applicant: General Electric Company, Schenectady, NY (US)

(72) Inventor: Jason Joseph Bellardi, Cincinnati, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 432 days.

(21) Appl. No.: 15/706,860

(22) Filed: Sep. 18, 2017

(65) Prior Publication Data

US 2019/0086081 A1 Mar. 21, 2019

(51) Int. Cl.

| | |
|---|---|
| ***F23R 3/00*** | (2006.01) |
| ***F23M 5/00*** | (2006.01) |
| ***F23R 3/06*** | (2006.01) |
| ***F23R 3/28*** | (2006.01) |

(52) U.S. Cl.

CPC ..... *F23R 3/002* (2013.01); *F23M 5/00* (2013.01); *F23R 3/06* (2013.01); *F23R 3/283* (2013.01); *F23R 2900/00018* (2013.01); *F23R 2900/00019* (2013.01)

(58) Field of Classification Search

CPC ..... F23R 3/283; F23R 3/002; F23R 2900/00012; F23R 2900/00018; F02C 7/264; F02C 3/06; F23D 2207/00; F05D 2230/31; F23M 5/00

See application file for complete search history.

(56) References Cited

U.S. PATENT DOCUMENTS

| | | | | |
|---|---|---|---|---|
| 4,863,467 | A | 9/1989 | Bokros | |
| 5,711,343 | A | 1/1998 | Beckett | |
| 7,134,286 | B2 * | 11/2006 | Markarian | F23R 3/10 60/796 |
| 7,674,361 | B2 | 3/2010 | Cohen | |
| 7,758,018 | B2 | 7/2010 | Pereira Madeira | |
| 8,875,484 | B2 * | 11/2014 | Lains | F02C 7/266 60/39.821 |
| 9,500,230 | B2 | 11/2016 | Hiller et al. | |

(Continued)

FOREIGN PATENT DOCUMENTS

WO WO2016/133497 A1 8/2016

*Primary Examiner* — Scott J Walthour
*Assistant Examiner* — Todd N Jordan
(74) *Attorney, Agent, or Firm* — Michele V. Frank; Edward A. Kmett; Venable LLP

(57) ABSTRACT

A combustor assembly for a gas turbine engine and a method of additively manufacturing the same are provided. A combustor dome includes a combustor wall defining a hole and a circumferential groove defined within the combustor wall around the hole. A floating ferrule assembly is additively manufactured with the combustor dome and includes a ferrule positioned at least partially within the hole and defining a radial lip that is received within the circumferential groove to inseparably position the ferrule within the combustor wall. A build support arm is attached to the ferrule by a frangible connecting member, the frangible connecting member being breakable for separating and removing the build support arm from the ferrule.

18 Claims, 5 Drawing Sheets

(56) References Cited

U.S. PATENT DOCUMENTS

| | | | | |
|---|---|---|---|---|
| 9,562,616 | B2 | 2/2017 | Strom et al. | |
| 9,587,831 | B2 * | 3/2017 | Jause | F02C 7/20 |
| 10,151,486 | B2 * | 12/2018 | Sandoval | F23R 3/06 |
| 2011/0005231 | A1 * | 1/2011 | Low | F23R 3/14 60/740 |
| 2016/0069461 | A1 | 3/2016 | Chou et al. | |
| 2016/0238251 | A1 | 8/2016 | Chang | |
| 2016/0238253 | A1 * | 8/2016 | Moura | F23R 3/50 |
| 2017/0023061 | A1 | 1/2017 | Sanz | |
| 2017/0028640 | A1 | 2/2017 | Harrison et al. | |
| 2017/0072634 | A1 | 3/2017 | Reznar | |
| 2017/0096847 | A1 | 4/2017 | Liu et al. | |
| 2017/0356561 | A1 | 12/2017 | Reszewicz et al. | |
| 2018/0238209 | A1 | 8/2018 | Suzuki et al. | |
| 2018/0310772 | A1 | 11/2018 | Peters et al. | |

* cited by examiner

ADDITIVELY MANUFACTURED WALL AND FLOATING FERRULE HAVING A FRANGIBLE MEMBER BETWEEN THE FLOATING FERRULE AND A BUILD SUPPORT ARM

FIELD

The present subject matter relates generally to a gas turbine engine, or more particularly to a combustor assembly for a gas turbine engine.

BACKGROUND

A gas turbine engine generally includes a fan and a core arranged in flow communication with one another. Additionally, the core of the gas turbine engine general includes, in serial flow order, a compressor section, a combustion section, a turbine section, and an exhaust section. In operation, air is provided from the fan to an inlet of the compressor section where one or more axial compressors progressively compress the air until it reaches the combustion section. Fuel is mixed with the compressed air and burned within the combustion section to provide combustion gases. The combustion gases are routed from the combustion section to the turbine section. The flow of combustion gases through the turbine section drives the turbine section and is then routed through the exhaust section, e.g., to atmosphere.

Conventional combustor assemblies include various components that are inserted into the combustor domes to facilitate the combustion process. For example, fuel injectors may be inserted through fuel injection ports and/or igniters may be inserted through igniter ports into the combustor dome. During operation, and particularly during transient operation such as start-up when large temperature differences may be experienced, thermal expansion causes the fuel injectors and/or igniters to move relative to the combustor dome. To reduce stress between the components and ensure proper operation, certain combustor assemblies may include floating collars for receiving the fuel injectors and floating ferrules for receiving the igniters. However, such features frequently require multiple components to be manufactured and assembled, resulting in increased costs and other operability issues.

Accordingly, a gas turbine engine with an improved combustor assembly would be useful. More specifically, a combustor assembly that includes floating collar assemblies for receiving fuel injectors and/or ferrule assemblies for receiving igniters within the combustor dome would be particularly beneficial.

BRIEF DESCRIPTION

Aspects and advantages of the invention will be set forth in part in the following description, or may be obvious from the description, or may be learned through practice of the invention.

In one exemplary embodiment of the present disclosure, an additively manufactured combustor assembly for a gas turbine engine is provided. The combustor assembly includes a combustor dome including a combustor wall defining a hole and a circumferential groove defined within the combustor wall around the hole. A floating ferrule assembly is additively manufactured with the combustor dome and includes a ferrule defining an axial direction and a radial direction, the ferrule being positioned at least partially within the hole and defining a radial lip that is received within the circumferential groove to inseparably position the ferrule within the combustor wall.

In another exemplary embodiment of the present disclosure, a method for manufacturing a combustor assembly for a gas turbine engine is provided. The method includes depositing a layer of additive material on a bed of an additive manufacturing machine and selectively directing energy from an energy source onto the layer of additive material to fuse a portion of the additive material and form the combustor assembly. The combustor assembly includes a combustor dome including a combustor wall defining a hole and a circumferential groove defined within the combustor wall around the hole. A ferrule is positioned at least partially within the hole and defines a radial lip that is received within the circumferential groove to inseparably position the ferrule within the combustor wall, a build support arm, and a frangible connecting member extending between the build support arm and the ferrule. The method further includes breaking the frangible connecting member and removing the build support arm to permit relative motion between the combustor dome and the ferrule.

According to still another exemplary embodiment of the present disclosure, an additively manufactured component is provided. The component includes a wall defining a hole and a circumferential groove defined within the wall around the hole. A floating assembly is additively manufactured with the wall and includes a floating member positioned at least partially within the hole and defining a lip that is received within the circumferential groove to inseparably position the floating member within the wall.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
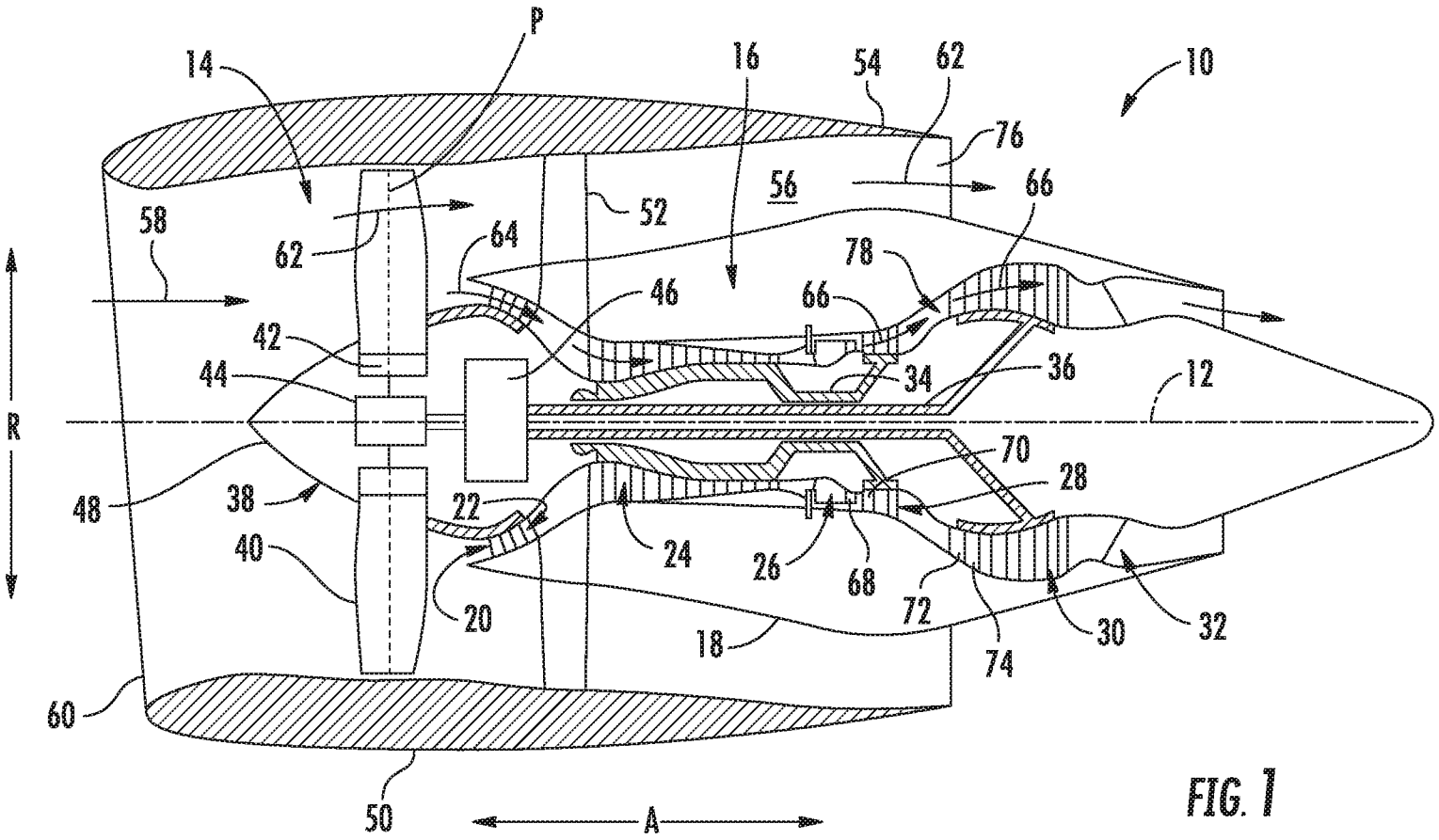
FIG. 1 is a schematic cross-sectional view of an exemplary gas turbine engine according to various embodiments of the present subject matter.

Repeat use of reference characters in the present specification and drawings is intended to represent the same or analogous features or elements of the present invention.

DETAILED DESCRIPTION

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "forward" and "aft" refer to relative positions within a gas turbine engine, with forward referring to a position closer to an engine inlet and aft referring to a position closer to an engine nozzle or exhaust. The terms "upstream" and "downstream" refer to the relative direction with respect to fluid flow in a fluid pathway. For example, "upstream" refers to the direction from which the fluid flows, and "downstream" refers to the direction to which the fluid flows. Furthermore, as used herein, terms of approximation, such as "approximately," "substantially," or "about," refer to being within a ten percent margin of error.

The present disclosure is generally directed to a combustor assembly for a gas turbine engine and a method of additively manufacturing the same. A combustor dome includes a combustor wall defining a hole and a circumferential groove defined within the combustor wall around the hole. A floating ferrule assembly is additively manufactured with the combustor dome and includes a ferrule positioned at least partially within the hole and defining a radial lip that is received within the circumferential groove to inseparably position the ferrule within the combustor wall. A build support arm is attached to the ferrule by a frangible connecting member, the frangible connecting member being breakable for separating and removing the build support arm from the ferrule.

Referring now to the drawings, FIG. 1 is a schematic cross-sectional view of a gas turbine engine in accordance with an exemplary embodiment of the present disclosure. More particularly, for the embodiment of FIG. 1, the gas turbine engine is a high-bypass turbofan jet engine 10, referred to herein as "turbofan engine 10." As shown in FIG. 1, the turbofan engine 10 defines an axial direction A (extending parallel to a longitudinal centerline or central axis 12 provided for reference) and a radial direction R. In general, the turbofan 10 includes a fan section 14 and a core turbine engine 16 disposed downstream from the fan section 14.

The exemplary core turbine engine 16 depicted generally includes a substantially tubular outer casing 18 that defines an annular inlet 20. The outer casing 18 encases, in serial flow relationship, a compressor section including a booster or low pressure (LP) compressor 22 and a high pressure (HP) compressor 24; a combustor or combustion section 26; a turbine section including a high pressure (HP) turbine 28 and a low pressure (LP) turbine 30; and a jet exhaust nozzle section 32. A high pressure (HP) shaft or spool 34 drivingly connects the HP turbine 28 to the HP compressor 24. A low pressure (LP) shaft or spool 36 drivingly connects the LP turbine 30 to the LP compressor 22.

For the embodiment depicted, the fan section 14 includes a variable pitch fan 38 having a plurality of fan blades 40 coupled to a disk 42 in a spaced apart manner. As depicted, the fan blades 40 extend outwardly from disk 42 generally along the radial direction R. Each fan blade 40 is rotatable relative to the disk 42 about a pitch axis P by virtue of the fan blades 40 being operatively coupled to a suitable actuation member 44 configured to collectively vary the pitch of the fan blades 40 in unison. The fan blades 40, disk 42, and actuation member 44 are together rotatable about the longitudinal axis 12 by LP shaft 36 across a power gear box 46. The power gear box 46 includes a plurality of gears for stepping down the rotational speed of the LP shaft 36 to a more efficient rotational fan speed.

Referring still to the exemplary embodiment of FIG. 1, the disk 42 is covered by rotatable front hub 48 aerodynamically contoured to promote an airflow through the plurality of fan blades 40. Additionally, the exemplary fan section 14 includes an annular fan casing or outer nacelle 50 that circumferentially surrounds the fan 38 and/or at least a portion of the core turbine engine 16. It should be appreciated that the nacelle 50 may be configured to be supported relative to the core turbine engine 16 by a plurality of circumferentially-spaced outlet guide vanes 52. Moreover, a downstream section 54 of the nacelle 50 may extend over an outer portion of the core turbine engine 16 so as to define a bypass airflow passage 56 therebetween.

During operation of the turbofan engine 10, a volume of air 58 enters the turbofan 10 through an associated inlet 60 of the nacelle 50 and/or fan section 14. As the volume of air 58 passes across the fan blades 40, a first portion of the air 58 as indicated by arrows 62 is directed or routed into the bypass airflow passage 56 and a second portion of the air 58 as indicated by arrow 64 is directed or routed into the LP compressor 22. The ratio between the first portion of air 62 and the second portion of air 64 is commonly known as a bypass ratio. The pressure of the second portion of air 64 is then increased as it is routed through the high pressure (HP) compressor 24 and into the combustion section 26, where it is mixed with fuel and burned to provide combustion gases 66.

The combustion gases 66 are routed through the HP turbine 28 where a portion of thermal and/or kinetic energy from the combustion gases 66 is extracted via sequential stages of HP turbine stator vanes 68 that are coupled to the outer casing 18 and HP turbine rotor blades 70 that are coupled to the HP shaft or spool 34, thus causing the HP shaft or spool 34 to rotate, thereby supporting operation of the HP compressor 24. The combustion gases 66 are then routed through the LP turbine 30 where a second portion of thermal and kinetic energy is extracted from the combustion gases 66 via sequential stages of LP turbine stator vanes 72 that are coupled to the outer casing 18 and LP turbine rotor blades 74 that are coupled to the LP shaft or spool 36, thus causing the LP shaft or spool 36 to rotate, thereby supporting operation of the LP compressor 22 and/or rotation of the fan 38.

The combustion gases 66 are subsequently routed through the jet exhaust nozzle section 32 of the core turbine engine 16 to provide propulsive thrust. Simultaneously, the pressure of the first portion of air 62 is substantially increased as the first portion of air 62 is routed through the bypass airflow passage 56 before it is exhausted from a fan nozzle exhaust section 76 of the turbofan 10, also providing propulsive thrust. The HP turbine 28, the LP turbine 30, and the jet exhaust nozzle section 32 at least partially define a hot gas path 78 for routing the combustion gases 66 through the core turbine engine 16.

It should be appreciated that the exemplary turbofan 10 depicted in FIG. 1 is by way of example only and that in other exemplary embodiments, turbofan 10 may have any other suitable configuration. For example, it should be appreciated that in other exemplary embodiments, turbofan 10 may instead be configured as any other suitable turbine engine, such as a turboprop engine, turbojet engine, internal combustion engine, etc.

Referring now generally to FIGS. 2 through 6, a combustor assembly 100 is provided in accordance with an exemplary embodiment of the present disclosure. For example, combustor assembly 100 may be positioned in the combustion section 26 of the exemplary turbofan engine 10 of FIG. 1. However, it should be appreciated that combustor assembly 100 can be configured for use in any suitable engine and the concepts described herein could be similarly used in automotive, aviation, maritime, and other industries to assist in a combustion process. Moreover, FIG. 1 illustrates an exemplary embodiment of combustor assembly 100 for the purpose of explaining its general operation, but the size, shape, and configuration of combustor assembly 100 is not intended to limit the scope of the present subject matter.

In general, the exemplary embodiments of combustor assembly 100 described herein may be manufactured or formed using any suitable process. However, in accordance with several aspects of the present subject matter, some or all of combustor assembly 100 may be formed using an additive-manufacturing process, such as a 3-D printing process. The use of such a process may allow combustor assembly 100 to be formed integrally, as a single monolithic component, or as any suitable number of sub-components. In particular, the manufacturing process may allow combustor assembly 100 to be integrally formed and include a variety of features not possible when using prior manufacturing methods. For example, the additive manufacturing methods described herein enable the manufacture of combustor assemblies having unique features, configurations, thicknesses, materials, densities, and structures not possible using prior manufacturing methods. Some of these novel features can, for example, permit relative motion between two components of combustor assembly 100 after simultaneous formation of such components using an additive manufacturing process as described herein.

As used herein, the terms "additively manufactured" or "additive manufacturing techniques or processes" refer generally to manufacturing processes wherein successive layers of material(s) are provided on each other to "build-up," layer-by-layer, a three-dimensional component. The successive layers generally fuse together to form a monolithic component which may have a variety of integral sub-components. Although additive manufacturing technology is described herein as enabling fabrication of complex objects by building objects point-by-point, layer-by-layer, typically in a vertical direction, other methods of fabrication are possible and within the scope of the present subject matter. For example, although the discussion herein refers to the addition of material to form successive layers, one skilled in the art will appreciate that the methods and structures disclosed herein may be practiced with any additive manufacturing technique or manufacturing technology. For example, embodiments of the present invention may use layer-additive processes, layer-subtractive processes, or hybrid processes.

Suitable additive manufacturing techniques in accordance with the present disclosure include, for example, Fused Deposition Modeling (FDM), Selective Laser Sintering (SLS), 3D printing such as by inkjets, laser jets, and binder jets, Sterolithography (SLA), Direct Selective Laser Sintering (DSLS), Electron Beam Sintering (EBS), Electron Beam Melting (EBM), Laser Engineered Net Shaping (LENS), Laser Net Shape Manufacturing (LNSM), Direct Metal Deposition (DMD), Digital Light Processing (DLP), Direct Selective Laser Melting (DSLM), Selective Laser Melting (SLM), Direct Metal Laser Melting (DMLM), and other known processes.

The additive manufacturing processes described herein may be used for forming components using any suitable material. For example, the material may be plastic, metal, concrete, ceramic, polymer, epoxy, photopolymer resin, or any other suitable material that may be in solid, liquid, powder, sheet material, wire, or any other suitable form or combinations thereof. More specifically, according to exemplary embodiments of the present subject matter, the additively manufactured components described herein may be formed in part, in whole, or in some combination of materials including but not limited to pure metals, nickel alloys, chrome alloys, titanium, titanium alloys, magnesium, magnesium alloys, aluminum, aluminum alloys, and nickel or cobalt based superalloys (e.g., those available under the name Inconel® available from Special Metals Corporation). These materials are examples of materials suitable for use in the additive manufacturing processes described herein, and may be generally referred to as "additive materials."

In addition, one skilled in the art will appreciate that a variety of materials and methods for bonding those materials may be used and are contemplated as within the scope of the present disclosure. As used herein, references to "fusing" may refer to any suitable process for creating a bonded layer of any of the above materials. For example, if an object is made from polymer, fusing may refer to creating a thermoset bond between polymer materials. If the object is epoxy, the bond may be formed by a crosslinking process. If the material is ceramic, the bond may be formed by a sintering process. If the material is powdered metal, the bond may be formed by a melting or sintering process. One skilled in the art will appreciate that other methods of fusing materials to make a component by additive manufacturing are possible, and the presently disclosed subject matter may be practiced with those methods.

In addition, the additive manufacturing process disclosed herein allows a single component to be formed from multiple materials. Thus, the components described herein may be formed from any suitable mixtures of the above materials. For example, a component may include multiple layers, segments, or parts that are formed using different materials, processes, and/or on different additive manufacturing machines. In this manner, components may be constructed which have different materials and material properties for meeting the demands of any particular application. In addition, although the components described herein are constructed entirely by additive manufacturing processes, it should be appreciated that in alternate embodiments, all or a portion of these components may be formed via casting, machining, and/or any other suitable manufacturing process. Indeed, any suitable combination of materials and manufacturing methods may be used to form these components.

An exemplary additive manufacturing process will now be described. Additive manufacturing processes fabricate components using three-dimensional (3D) information, for example a three-dimensional computer model, of the component. Accordingly, a three-dimensional design model of the component may be defined prior to manufacturing. In this regard, a model or prototype of the component may be scanned to determine the three-dimensional information of the component. As another example, a model of the component may be constructed using a suitable computer aided design (CAD) program to define the three-dimensional design model of the component.

The design model may include 3D numeric coordinates of the entire configuration of the component including both external and internal surfaces of the component. For example, the design model may define the body, the surface, and/or internal passageways such as openings, support structures, etc. In one exemplary embodiment, the three-dimensional design model is converted into a plurality of slices or segments, e.g., along a central (e.g., vertical) axis of the component or any other suitable axis. Each slice may define a thin cross section of the component for a predetermined height of the slice. The plurality of successive cross-sectional slices together form the 3D component. The component is then "built-up" slice-by-slice, or layer-by-layer, until finished.

In this manner, the components described herein may be fabricated using the additive process, or more specifically each layer is successively formed, e.g., by fusing or polymerizing a plastic using laser energy or heat or by sintering or melting metal powder. For example, a particular type of additive manufacturing process may use an energy beam, for example, an electron beam or electromagnetic radiation such as a laser beam, to sinter or melt a powder material. Any suitable laser and laser parameters may be used, including considerations with respect to power, laser beam spot size, and scanning velocity. The build material may be formed by any suitable powder or material selected for enhanced strength, durability, and useful life, particularly at high temperatures.

Each successive layer may be, for example, between about 10 μm and 200 μm, although the thickness may be selected based on any number of parameters and may be any suitable size according to alternative embodiments. Therefore, utilizing the additive formation methods described above, the components described herein may have cross sections as thin as one thickness of an associated powder layer, e.g., 10 μm, utilized during the additive formation process.

In addition, utilizing an additive process, the surface finish and features of the components may vary as need depending on the application. For example, the surface finish may be adjusted (e.g., made smoother or rougher) by selecting appropriate laser scan parameters (e.g., laser power, scan speed, laser focal spot size, etc.) during the additive process, especially in the periphery of a cross-sectional layer which corresponds to the part surface. For example, a rougher finish may be achieved by increasing laser scan speed or decreasing the size of the melt pool formed, and a smoother finish may be achieved by decreasing laser scan speed or increasing the size of the melt pool formed. The scanning pattern and/or laser power can also be changed to change the surface finish in a selected area.

Notably, in exemplary embodiments, several features of the components described herein were previously not possible due to manufacturing restraints. However, the present inventors have advantageously utilized current advances in additive manufacturing techniques to develop exemplary embodiments of such components generally in accordance with the present disclosure. While the present disclosure is not limited to the use of additive manufacturing to form these components generally, additive manufacturing does provide a variety of manufacturing advantages, including ease of manufacturing, reduced cost, greater accuracy, etc.

In this regard, utilizing additive manufacturing methods, even multi-part components may be formed as a single piece of continuous metal, and may thus include fewer sub-components and/or joints compared to prior designs. The integral formation of these multi-part components through additive manufacturing may advantageously improve the overall assembly process. For example, the integral formation reduces the number of separate parts that must be assembled, thus reducing associated time and overall assembly costs. Additionally, existing issues with, for example, leakage, joint quality between separate parts, and overall performance may advantageously be reduced.

Also, the additive manufacturing methods described above enable much more complex and intricate shapes and contours of the components described herein. For example, such components may include thin additively manufactured layers and features that allow for relative motion between sub-components. In addition, the additive manufacturing process enables the manufacture of a single component having different materials such that different portions of the component may exhibit different performance characteristics. The successive, additive nature of the manufacturing process enables the construction of these novel features. As a result, the components described herein may exhibit improved functionality and reliability.

Figure 2:
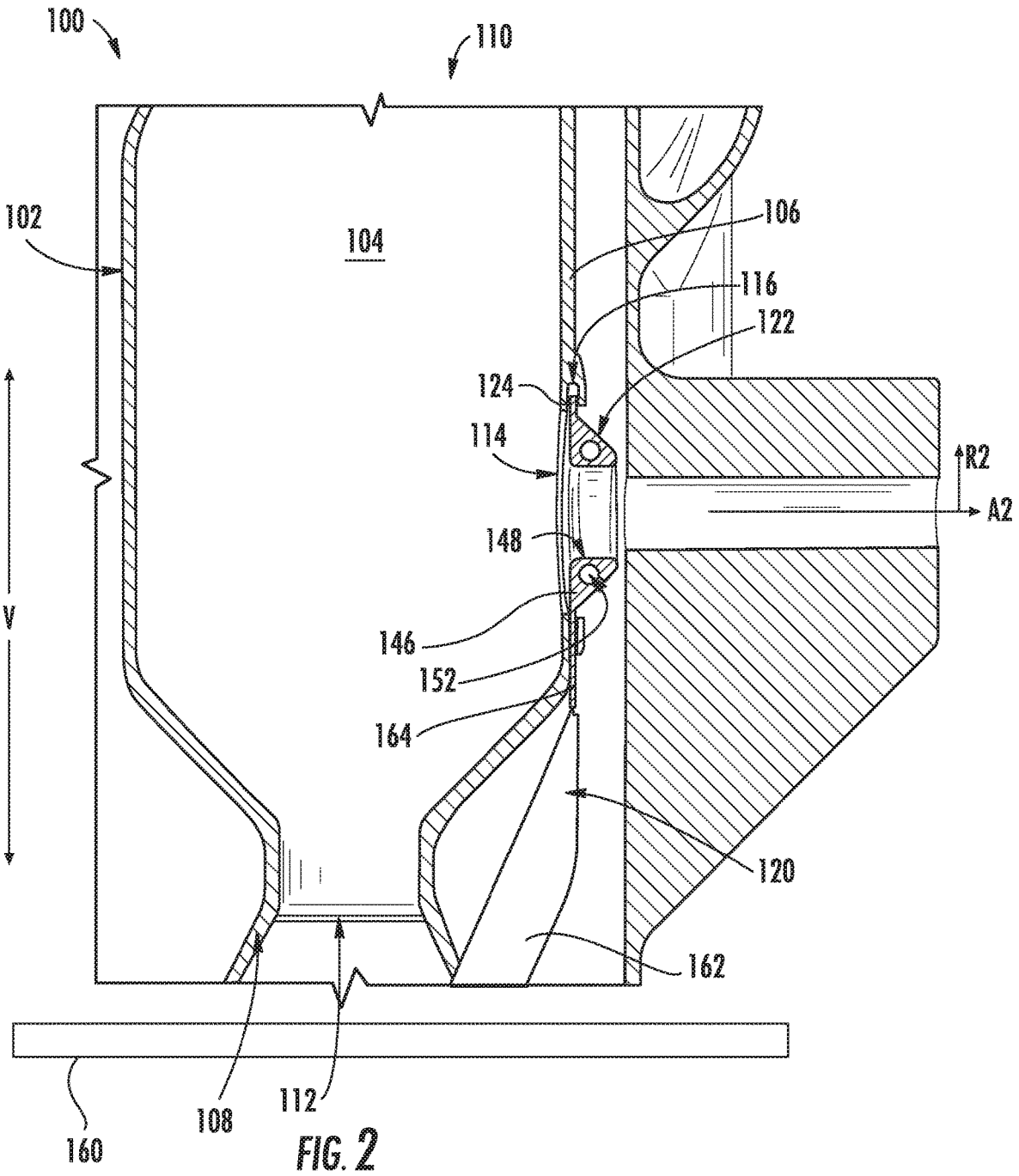
FIG. 2 is a cross-sectional view of a combustor assembly in accordance with an exemplary embodiment of the present disclosure.

Referring now specifically to FIG. 2, a cross-sectional view is provided of a combustor assembly 100 in accordance with an exemplary embodiment of the present disclosure. Notably, FIG. 2 illustrates only portions of combustor assembly 100 for the purpose of explaining aspects of the present subject matter, while other components are removed for clarity. In addition, combustor assembly 100 is only one exemplary combustor and other types and configurations of combustor assemblies may be used according to alternative embodiments.

As shown, the combustor assembly 100 generally comprises a combustor dome 102 that defines a combustion chamber 104 within which fuel and air are combusted to support turbofan engine 10 operation. More specifically, combustor dome 102 is defined at least in part by one or more combustor liners or combustor walls 106 that together at least partially define a combustion chamber 104 therebetween. Combustor dome 102, or more particularly combustor wall 106 extends between a forward end 108 and an aft end 110.

In addition, combustor dome 102 may generally define features for receiving components to support the combustion process. For example, as shown in FIG. 2, combustor dome 102 may define a plurality of circumferentially spaced fuel injection ports 112 proximate forward end 108. Combustor assembly 100 further includes a plurality of fuel injector assemblies, referred to herein as fuel injectors (not shown), which may include premixers, fuel-air mixers, or similar assemblies, and are generally configured for supplying a mixture of fuel and air into combustion chamber 104 to facilitate combustion. According to an exemplary embodiment, fuel injectors are inserted into each of the plurality of fuel injection ports 112.

In addition, combustor assembly may include one or more igniters or igniter assemblies (not shown) which are inserted into or positioned proximate to combustor chamber 104 to ignite the fuel/air mixture provided therein. More specifically, as illustrated in FIG. 2, combustor wall 106 defines one or more igniter holes 114 for receiving such an igniter assembly such that the igniter extends into combustion chamber 104 through igniter hole 114.

As explained briefly above, fuel injectors, igniters, and any other components that are operably coupled to combustor dome 102 can present problems due to the differing mechanical characteristics of the components. More specifically, because the components are attached to different portions of turbofan engine 10, are constructed of materials having different coefficients of thermal expansion, and are exposed to different temperatures, thermal expansion can cause significant relative movement between these components and combustor dome 102. Features for facilitating the use of igniters in a combustor wall 106 are described below. However, it should be appreciated that aspects of the present subject matter may be used to facilitate the use of other components, such as fuel injectors, in combustor assembly 100 to accommodate relative thermal expansion to reduce potential stresses between the components while ensuring operability of combustor assembly 100.

Figure 3:
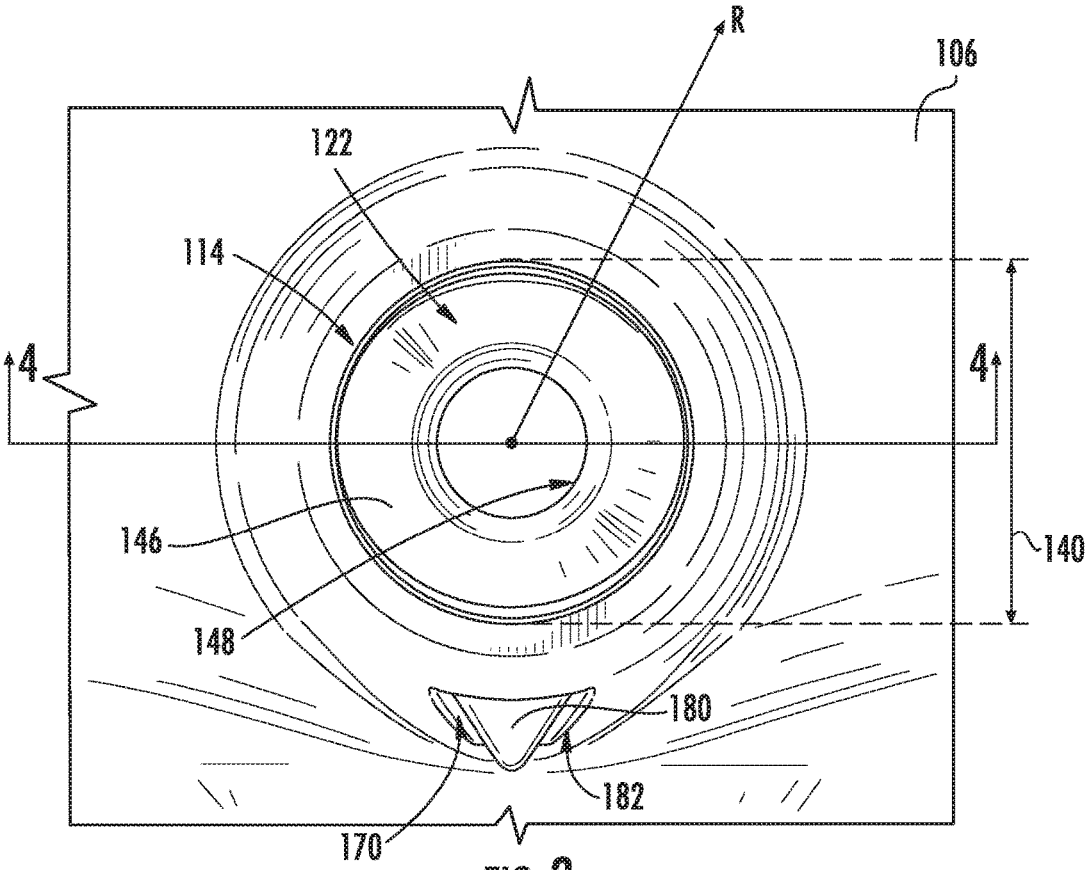
FIG. 3 is a perspective view of a ferrule positioned within a combustor wall of the exemplary combustor assembly of FIG. 2 according to an exemplary embodiment of the present subject matter.
Figure 4:
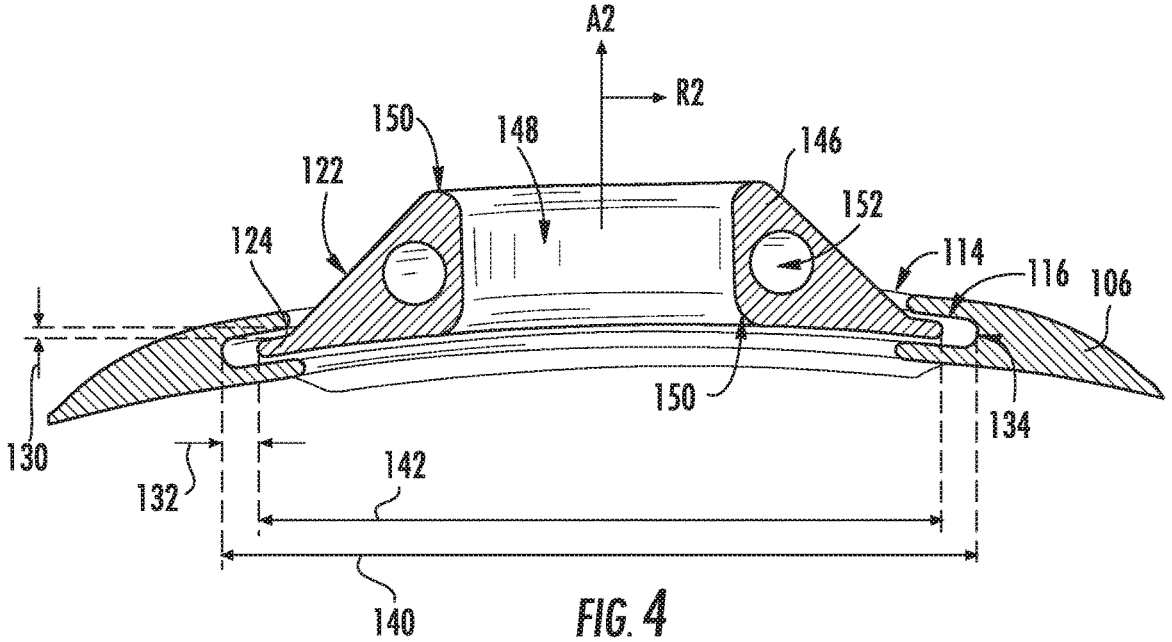
FIG. 4 is a cross-sectional view of the exemplary ferrule of FIG. 3 taken along Line 4-4 of FIG. 3.

Referring now generally to FIGS. 2 through 4, igniter hole 114 is defined in combustor wall 106 slightly downstream of forward end 108. Combustor wall further defines a circumferential groove 116 that extends around igniter hole 114. As described below, igniter hole 114 and circumferential groove 116 are generally configured for receiving a floating ferrule assembly 120. More specifically, igniter hole 114 and circumferential groove 116 are configured for receiving a ferrule 122 of floating ferrule assembly 120 such that ferrule 122 is retained within combustor wall 106 but may move relative to combustor wall 106.

Figure 5:
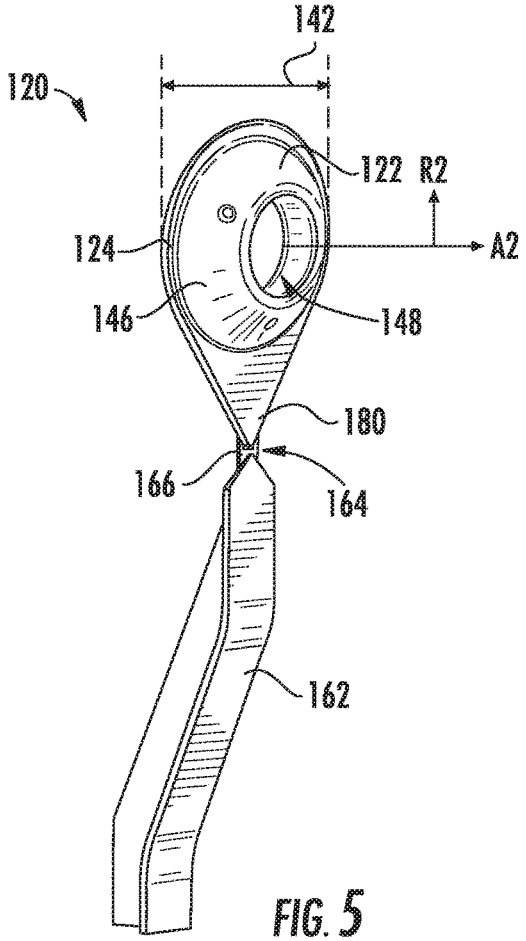
FIG. 5 is a perspective view of a floating ferrule assembly that may facilitate the additive manufacturing of the exemplary ferrule of FIG. 3 within the exemplary combustor assembly of FIG. 2.
Figure 6:
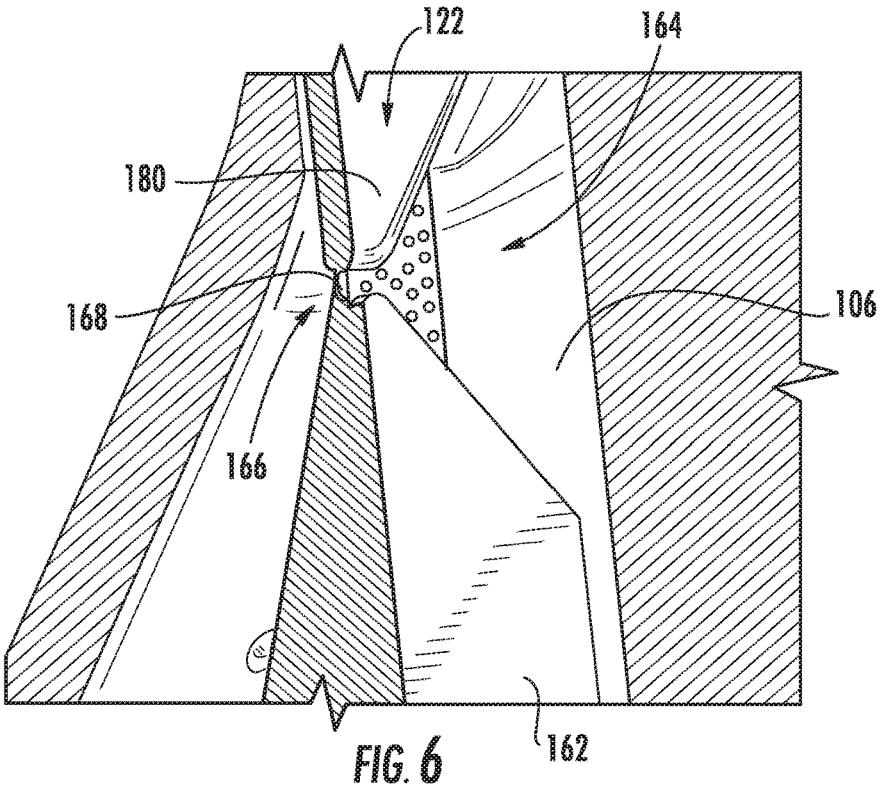
FIG. 6 is a close-up cross sectional view of a frangible connecting member of the exemplary floating ferrule assembly of FIG. 5.

Referring now also to FIGS. 5 and 6, floating ferrule assembly 120 generally includes ferrule 122 which defines an axial direction A2 and a radial direction R2. Ferrule 122 is positioned at least partially within igniter hole 114 and defines a radial lip 124 that is received within circumferential groove 116. In this manner, ferrule 122 is inseparably positioned within combustor wall 106. Moreover, ferrule 122 may slide relative to combustor wall 106 to reduce stress on an igniter (not shown) which is received in ferrule 122, as described in more detail below.

FIG. 4 is a cross sectional illustration of ferrule 122 when it is positioned within igniter hole 114 and circumferential groove 116 of combustor dome 102. As shown, an axial gap 130 is defined between ferrule 122 and combustor wall 106 along the axial direction A2. More specifically, axial gaps 130 are defined on both sides of radial lip 124 of ferrule 122 within circumferential groove 116. Axial gaps 130 may be any suitable size for ensuring that ferrule 122 does not fuse to combustor wall 106 during the additive manufacturing process and that ferrule 122 may move relative to combustor wall 106 while still being retained within igniter hole 114. According to one exemplary embodiment, axial gap 130 may be between about 0.05 millimeters and 1 millimeters. According to still another embodiment, axial gap 130 may be between about 0.1 millimeters and 0.5 millimeters, or even less than 0.1 millimeters.

Similarly, still referring to FIG. 4, a radial gap 132 is defined between ferrule 122 and combustor wall 106 along the radial direction R2. More specifically, radial gap 132 is defined between the radially outermost portion of radial lip 124 and a bottom 134 (or deepest point) of circumferential groove 116. Radial gap 132 is generally sized to permit sufficient relative motion between an igniter inserted through ferrule 122 and combustor wall 106 or combustor dome 102. For example, radial gap 132 may be greater than about 0.5 millimeters, greater than about 1 millimeter, or greater than about 2 millimeters. Any other suitable size or shape of circumferential groove 116 and/or radial lip 124 may be used according to alternative embodiments to achieve the desired amount of relative motion between ferrule 122 and combustor dome 102.

According to the illustrated embodiment, igniter hole 114 and circumferential groove 116 are substantially circular in cross section and ferrule 122 is shaped for receipt within these features. However, it should be appreciated that igniter hole 114 and circumferential groove 116 may be any suitable shape for accommodating floating ferrule assembly 120 or ferrule 122. Indeed, these features may have any size, shape, and position suitable for retaining ferrule 122 while allowing some motion relative to combustor wall 106.

For example, as illustrated in FIG. 4, ferrule 122 is appropriately sized to permit relative motion while ensuring the ferrule 122 is retained within igniter hole 114. In this regard, igniter hole 114 of combustor wall 106 defines a hole diameter 140 and radial lip 124 of ferrule 122 defines a lip diameter 142. In order to prevent ferrule 122 from falling out of igniter hole 114, according to an exemplary embodiment, lip diameter 142 is larger than hole diameter 140.

In addition, ferrule 122 may define an annular body 146 that is thickened relative to radial lip 124 to prevent ferrule 122 from sliding too far into circumferential groove 116. Referring generally to FIGS. 2 through 6, annular body 146 of ferrule 122 defines a receiving channel 148 extending along the axial direction A2 and being substantially concentric with igniter hole 114 defined in combustor wall 106. Receiving channel 148 may be sized to receive a suitable igniter and provide a substantially airtight seal around the igniter. In addition, receiving channel 148 may define radiused corners 150 to facilitate installation of the igniter. In order to reduce overall weight, ferrule 122 may further define a void space 152 extending circumferentially within annular body 146 of ferrule 122.

Notably, according to the exemplary embodiment described herein, floating ferrule assembly 120 is additively manufactured with combustor dome 102. For example, as illustrated schematically in FIG. 2, combustor assembly 100 generally defines a vertical direction V and combustor dome 102 and floating ferrule assembly 120 are additively manufactured on a build platform 160 along the vertical direction V. In this regard, floating ferrule assembly 120 and combustor dome 102 are thus additively manufactured (e.g., "printed") simultaneously layer-by-layer along the vertical direction V using one or more of the additive manufacturing techniques described above.

To support such a simultaneous build while ensuring ferrule 122 may move freely within igniter hole 114 and circumferential groove 116, floating ferrule assembly includes a build support arm 162. As best illustrated in FIGS. 2, 5, and 6, build support arm 162 extends substantially along the vertical direction V between build platform 160 and ferrule 122, e.g., such that build support arm 162 is positioned below ferrule 122 and provides a vertical support structure for the additive manufacturing process.

Moreover, as best illustrated in FIGS. 5 and 6, build support arm 162 is attached to ferrule 122 by a frangible connecting member 164. Frangible connecting member 164 extends generally along the vertical direction V from build support arm 162 to ferrule 122 and is breakable for separating and removing build support arm 162 from ferrule 122. In this manner, floating ferrule assembly 120, including ferrule 122, build support arm 162, and frangible connecting member 164, are integrally formed as a single monolithic component during the additive manufacturing process. However, after combustor assembly 100 is printed, build support member 162 may be wiggled, pulled, or otherwise manipulated to manually break frangible connecting member 164. Build support member 162 is then removed from combustor assembly 100 and ferrule 122 remains within igniter hole 114 and circumferential groove 116, where it is retained but can freely move therein.

Frangible connecting member 164 may generally be any region of floating ferrule assembly 120 that has a relatively low density or is otherwise configured for fracturing or breaking more readily than the rest of floating ferrule assembly 120. In this manner, frangible connecting member 164 is more easily broken for removal of build support arm 162. For example, as illustrated in FIG. 6, frangible connecting member 164 may define a necked portion 166 that is thinner than build support arm 162 and ferrule 122. In addition, frangible connecting member 164 may be intentionally printed at a lower density or to include porosity 168 such that frangible connecting member 164 provides vertical support for printing ferrule 122 but is easily breakable. According to still another embodiment, frangible connecting member 164 may define a series of voids along a fracture line (e.g., similar to perforated paper).

According to the illustrated embodiment, combustor wall 106 defines a build clearance hole 170 that extends from outside of combustor wall 106 into circumferential groove 116, or more specifically to a bottom of circumferential groove 116 along the vertical direction V. In this manner, some portion of floating ferrule assembly 120 such as ferrule 122, build support arm 162, or frangible connecting member 164 may extend substantially along the vertical direction V into circumferential groove 116 to provide the vertical support necessary for printing ferrule 122.

According to an exemplary embodiment of the present subject matter, it may be desirable to limit the rotation of ferrule 122 about the axial direction A2. Therefore, as best illustrated in FIGS. 3 and 5, combustor assembly 100 may include integral anti-rotation features for limiting the allowable angular rotation of ferrule 122. More specifically, as illustrated, ferrule 122 has a triangular protrusion 180 that extends along the radial direction R2 from radial lip 124. In addition, build clearance hole 170 may be defined by a complementary angled wall 182. In this manner, after combustor assembly 100 is printed and build support arm 162 is removed, ferrule 122 may move within circumferential groove 116 and may rotate only until triangular protrusion 180 engages angled wall 182. Moreover, triangular protrusion 180 facilitates the additive manufacturing process by providing vertical support for building ferrule 122. It should be appreciated that any other suitable anti-rotation features may be included according to alternative embodiments.

It should be appreciated that combustor assembly 100 is described herein only for the purpose of explaining aspects of the present subject matter. For example, combustor assembly 100 will be used herein to describe exemplary configurations, constructions, and methods of manufacturing combustor assembly 100. It should be appreciated that the additive manufacturing techniques discussed herein may be used to manufacture other combustor assemblies and components for use in any suitable device, for any suitable purpose, and in any suitable industry. Thus, the exemplary components and methods described herein are used only to illustrate exemplary aspects of the present subject matter and are not intended to limit the scope of the present disclosure in any manner.

Now that the construction and configuration of combustor assembly 100 according to an exemplary embodiment of the present subject matter has been presented, an exemplary method 200 for forming a combustor assembly according to an exemplary embodiment of the present subject matter is provided. Method 200 can be used by a manufacturer to form combustor assembly 100, or any other suitable combustor assembly. It should be appreciated that the exemplary method 200 is discussed herein only to describe exemplary aspects of the present subject matter, and is not intended to be limiting.

Figure 7:
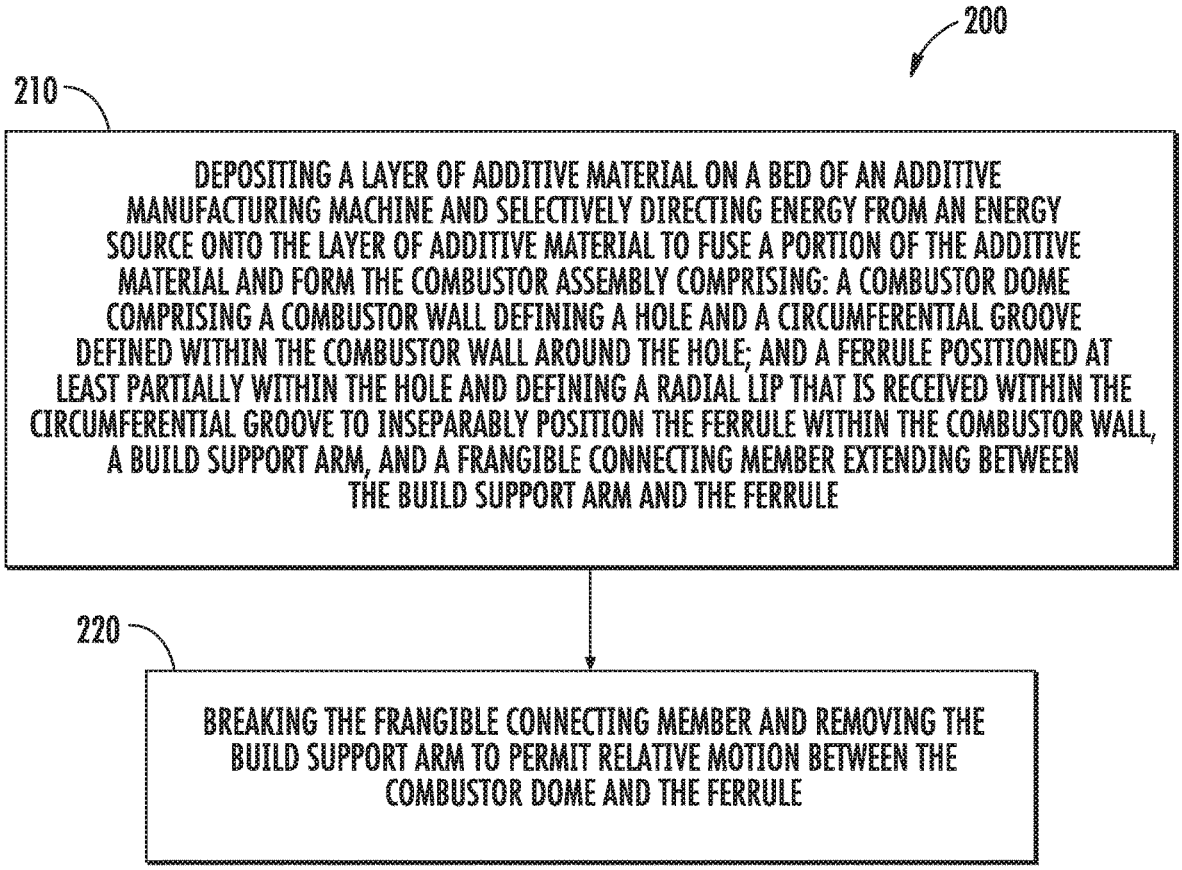
FIG. 7 is a method of manufacturing a combustor assembly according to an exemplary embodiment of the present subject matter.

Referring now to FIG. 7, method 200 includes, at step 210, depositing a layer of additive material on a bed of an additive manufacturing machine and selectively directing energy from an energy source onto the layer of additive material to fuse a portion of the additive material and form the combustor assembly. The combustor assembly formed may be similar in some or all respects to combustor assembly 100 described above.

For example, using the example from above, the combustor assembly formed at step 210 may include a combustor dome including a combustor wall defining a hole and a circumferential groove defined within the combustor wall around the hole. In addition, a ferrule may be positioned at least partially within the hole and define a radial lip that is received within the circumferential groove to inseparably position the ferrule within the combustor wall. A build support arm and a frangible connecting member may extend between the build support arm and the ferrule. Notably, according to an exemplary embodiment, the combustor dome and the ferrule may be simultaneously formed. More specifically, according to one embodiment, the ferrule, the build support arm, and the frangible connecting member are integrally formed as a single monolithic component and the combustor dome is additively manufactured simultaneously, but as a separate piece.

Method 200 may further include, at step 220, breaking the frangible connecting member and removing the build support arm to permit relative motion between the combustor dome and the ferrule. In this manner, the build support arm is removed entirely from the combustor assembly and the ferrule is contained within, but free to move relative to, the combustor dome.

FIG. 7 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 are explained using combustor assembly 100 as an example, it should be appreciated that these methods may be applied to manufacture any suitable combustor assembly or component.

An additively manufactured combustor assembly and a method for manufacturing that combustor assembly are described above. Notably, the combustor assembly may generally include performance-enhancing features whose practical implementations are facilitated by an additive manufacturing process. For example, using the additive manufacturing methods described herein, the combustor assembly may include a floating ferrule assembly that can position a ferrule in a hole of the combustor wall such that the ferrule is retained but may move relative to the combustor wall. These features may be introduced during the design of the combustor assembly, such that they may be easily integrated into the combustor assembly during the build process at little or no additional cost. Moreover, the entire combustor assembly, including the combustor dome, the floating ferrule assembly, and other features can be formed simultaneously as one or more integral and monolithic components.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An additively manufactured component, comprising:
- a wall defining a hole and a circumferential groove defined within the wall around the hole; and
- a floating assembly additively manufactured with the wall, the floating assembly comprising:
  - a floating member positioned at least partially within the hole and defining a lip that is received within the circumferential groove to inseparably position the floating member within the wall; and
  - a build support arm attached to the floating member by a frangible connecting member, wherein the frangible connecting member is structurally configured to be fractured more readily than the build support arm and is structurally configured to separate the build support arm from the floating member, wherein the frangible member defines at least one of:
    - a low density region of the floating assembly; and
    - a portion having a thickness that is less than a thickness of the build support arm.

2. The additively manufactured component of claim 1, wherein a gap is defined between the floating member and the wall, the gap being less than 0.5 millimeters.

3. An additively manufactured combustor assembly for a gas turbine engine, the combustor assembly comprising:
- a combustor dome comprising a combustor wall defining a hole and a circumferential groove defined within the combustor wall around the hole; and
- a floating ferrule assembly additively manufactured with the combustor dome, the floating ferrule assembly comprising:
- a ferrule defining an axial direction and a radial direction, the ferrule being positioned at least partially within the hole and defining a radial lip that is received within the circumferential groove to inseparably position the ferrule within the combustor wall;
- and a build support arm attached to the ferrule by a frangible connecting member, wherein the frangible connecting member is structurally configured to be fractured more readily than the build support arm and is structurally configured to separate the build support arm from the ferrule, and wherein the frangible connecting member defines at least one of:
- a low density region of the floating ferrule assembly; and
- a portion having a thickness that is less than a thickness of the build support arm.

4. The additively manufactured combustor assembly of claim 1, wherein the combustor wall further defines a build clearance hole passing into the circumferential groove, the floating ferrule assembly passing into the hole and the circumferential groove through the build clearance hole.

5. The additively manufactured combustor assembly of claim 1, wherein the frangible connecting member is a low density region of the floating ferrule assembly.

6. The additively manufactured combustor assembly of claim 1, wherein the ferrule, the build support arm, and the frangible connecting member are integrally formed as a single monolithic component.

7. The additively manufactured combustor assembly of claim 1, wherein an axial gap is defined between the ferrule and the combustor wall along the axial direction.

8. The additively manufactured combustor assembly of claim 7, wherein the axial gap is less than 0.5 millimeters.

9. The additively manufactured combustor assembly of claim 1, wherein a radial gap is defined between the ferrule and the combustor wall along the radial direction.

10. The additively manufactured combustor assembly of claim 1, wherein the ferrule defines a receiving channel extending along the axial direction and being substantially concentric with the hole defined in the combustor wall.

11. The additively manufactured combustor assembly of claim 1, wherein the hole of the combustor wall defines a hole diameter and the radial lip of the ferrule defines a lip diameter, the lip diameter being larger than the hole diameter.

12. The additively manufactured combustor assembly of claim 1, wherein the ferrule defines a void space extending circumferentially within the ferrule.

13. The additively manufactured combustor assembly of claim 1, wherein the additively manufactured combustor assembly defines a vertical direction, the combustor dome and floating ferrule assembly being additively manufactured on a build platform along the vertical direction, and wherein the build support arm is positioned below the ferrule along the vertical direction.

14. The additively manufactured combustor assembly of claim 1, wherein the additively manufactured combustor assembly comprises a plurality of layers formed by: depositing a layer of additive material on a bed of an additive manufacturing machine; and selectively directing energy from an energy source onto the layer of additive material to fuse a portion of the additive material.

15. A method for manufacturing a combustor assembly for a gas turbine engine, the method comprising:
- depositing a layer of additive material on a bed of an additive manufacturing machine and selectively directing energy from an energy source onto the layer of additive material to fuse a portion of the additive material and form the combustor assembly, the combustor assembly comprising:
  - a combustor dome comprising a combustor wall defining a hole and a circumferential groove defined within the combustor wall around the hole; and
  - a floating ferrule assembly additively manufactured with the combustor dome, the floating ferrule assembly comprising:
    - a ferrule defining an axial direction and a radial direction, the ferrule positioned at least partially within the hole and defining a radial lip that is received within the circumferential groove to inseparably position the ferrule within the combustor wall; and
    - a build support arm attached to the ferrule by a frangible connecting member, wherein the frangible connecting member is structurally configured to be fractured more readily than the build support arm and is structurally configured to separate the build support arm from the ferrule, wherein the frangible connecting member defines at least one of:

a low density region of the floating ferrule assembly; and a portion having a thickness that is less than a thickness of the build support arm; and breaking the frangible connecting member and removing the build support arm to permit relative motion between the combustor dome and the ferrule.

16. The method of claim 15, wherein an axial gap is defined between the ferrule and the combustor wall along the axial direction, wherein the axial gap is less than 0.5 millimeters.

17. The method of claim 15, wherein the combustor assembly defines a vertical direction, the combustor assembly being additively manufactured on a build platform along the vertical direction, and wherein the build support arm is positioned below the ferrule along the vertical direction.

18. The method of claim 15, wherein the ferrule, the build support arm, and the frangible connecting member are integrally formed as a single monolithic component.

* * * * *